US011873710B2

(12) United States Patent
Lloyd

(10) Patent No.: US 11,873,710 B2
(45) Date of Patent: Jan. 16, 2024

(54) MEASUREMENT OF INCLINATION AND TRUE VERTICAL DEPTH OF A WELLBORE

(71) Applicant: Halliburton Energy Services, Inc., Houston, TX (US)

(72) Inventor: Stephen Daniel Lloyd, Upton-upon-Severn (GB)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/894,512

(22) Filed: Aug. 24, 2022

(65) Prior Publication Data

US 2022/0403733 A1 Dec. 22, 2022

Related U.S. Application Data

(63) Continuation of application No. 16/644,071, filed as application No. PCT/US2017/055895 on Oct. 10, 2017, now Pat. No. 11,454,107.

(51) Int. Cl.

| | |
|---|---|
| ***E21B 47/0228*** | (2012.01) |
| ***E21B 47/26*** | (2012.01) |
| ***E21B 47/024*** | (2006.01) |

(52) U.S. Cl.

CPC ..... *E21B 47/0228* (2020.05); *E21B 47/024* (2013.01); *E21B 47/26* (2020.05)

(58) Field of Classification Search

CPC .... E21B 47/0228; E21B 47/024; E21B 47/26; E21B 47/022

USPC ..... 702/40

See application file for complete search history.

(56) References Cited

U.S. PATENT DOCUMENTS

| | | | |
|---|---|---|---|
| 4,083,117 | A | 4/1978 | Russell et al. |
| 4,956,921 | A | 9/1990 | Coles |
| 6,453,239 | B1 | 9/2002 | Shirasaka et al. |

(Continued)

FOREIGN PATENT DOCUMENTS

| | | |
|---|---|---|
| EP | 1184539 | 3/2002 |

OTHER PUBLICATIONS

Estes, R., and P. Walters. "Improvement of Azimuth Accuracy by Use of Iterative Total Field Calibration Technique and Compensation for System Environment Effects." SPE Annual Technical Conference and Exhibition. Society of Petropleum Engineers, 1989.

(Continued)

*Primary Examiner* — Alesa Allgood
*Assistant Examiner* — Byung Ro Lee
(74) *Attorney, Agent, or Firm* — Benjamin Ford; C. Tumey Law Group PLLC

(57) ABSTRACT

The accuracy of directional surveys may be improved using accelerometers, magnetometers, or both. A control system containing accelerometers is configured specifically to correct errors in bias and gain of each accelerometer by requiring the measured field strengths to be as constant as possible over several tool face angles over multiple points in a wellbore, even when all measurements are within a tangent or lateral section of a wellbore. Corrections for the bias and gain errors determined based on one or more measurements from the accelerometers are applied to measurements at other survey points to improve the accuracy of surveys and the efficiency of drilling operations.

19 Claims, 6 Drawing Sheets

(56) References Cited

U.S. PATENT DOCUMENTS

| | | | | |
|---|---|---|---|---|
| 6,714,870 | B1 * | 3/2004 | Weston | E21B 47/022 702/9 |
| 6,845,563 | B2 | 1/2005 | Lewis et al. | |
| 6,944,545 | B2 | 9/2005 | Close et al. | |
| 7,930,148 | B1 | 4/2011 | Figaro et al. | |
| 2008/0201969 | A1 * | 8/2008 | Davies | E21B 47/022 73/488 |
| 2010/0089572 | A1 | 4/2010 | Chang et al. | |
| 2012/0024606 | A1 | 2/2012 | Pirovolou et al. | |
| 2014/0202012 | A1 * | 7/2014 | Vogel | G01B 11/27 33/286 |
| 2015/0252623 | A1 * | 9/2015 | Nero | E21B 47/017 175/45 |
| 2015/0330210 | A1 | 11/2015 | Lozinsky | |
| 2015/0345283 | A1 * | 12/2015 | Switzer | E21B 47/024 73/152.54 |
| 2016/0145997 | A1 | 5/2016 | Van Steenwyk et al. | |
| 2016/0273340 | A1 * | 9/2016 | Roberson | G01V 99/005 |
| 2017/0138173 | A1 | 5/2017 | Estes et al. | |

OTHER PUBLICATIONS

International Search Report and Written Opinion issued in related PCT Application No. PCT/US2017/055895 dated Jul. 6, 2018, 19 pages.

Notice of Allowance for U.S. Appl. No. 16/644,071 dated May 25, 2022.

Non-Final Office Action Summary for U.S. Appl. No. 16/644,071 dated Dec. 13, 2021.

* cited by examiner

MEASUREMENT OF INCLINATION AND TRUE VERTICAL DEPTH OF A WELLBORE

BACKGROUND

The present disclosure relates generally to well drilling operations and, more particularly, to determining the geometry of a borehole while drilling.

Hydrocarbons, such as oil and gas, are commonly obtained from subterranean formations that may be located onshore or offshore. The development of subterranean operations and the processes involved in removing hydrocarbons from a subterranean formation are complex. Typically, subterranean operations involve a number of different steps such as, for example, drilling a wellbore at a desired well site, treating the wellbore to optimize production of hydrocarbons, and performing the necessary steps to produce and process the hydrocarbons from the subterranean formation.

During drilling operations of hydrocarbon producing wells, it is often necessary to track and adjust the geometry of a borehole being drilled. For example, a borehole may be designed to avoid known hazards located underground, such as water reservoirs, or a borehole may be designed with property right limitations and restrictions in mind. It may be desirable for an operator to be provided with inclination data while drilling to allow her to adjust drilling operation parameters as necessary in response to a change to inclination or orientation of the drill string, or confirm that the drilling system is in the correct position while drilling.

Typically, directional surveys are taken at regular intervals-at survey points-during drilling of an oil well using a sensor, such as an accelerometer, to determine the position of the wellbore along its length. In between each survey point, the drill string usually has been rotated. As a result, the orientation of the inclination sensor in the wellbore is likely to vary between each survey point. A sensor closely aligned to the wellbore axis will see small variation of readings for a given wellbore inclination. On the other hand, a sensor that is severely misaligned to the wellbore path will see a significant variation of individual sensor readings at a given inclination. Quartz hinged accelerometers are typically used for directional measurements in a downhole environment. Over time, these accelerometers can be subject to bias and gain shifts, and normally require periodic survey quality checks and subsequent adjustment by calibration.

FIGURES

Some specific exemplary embodiments of the disclosure may be understood by referring, in part, to the following description and the accompanying drawings.

Figure 1:
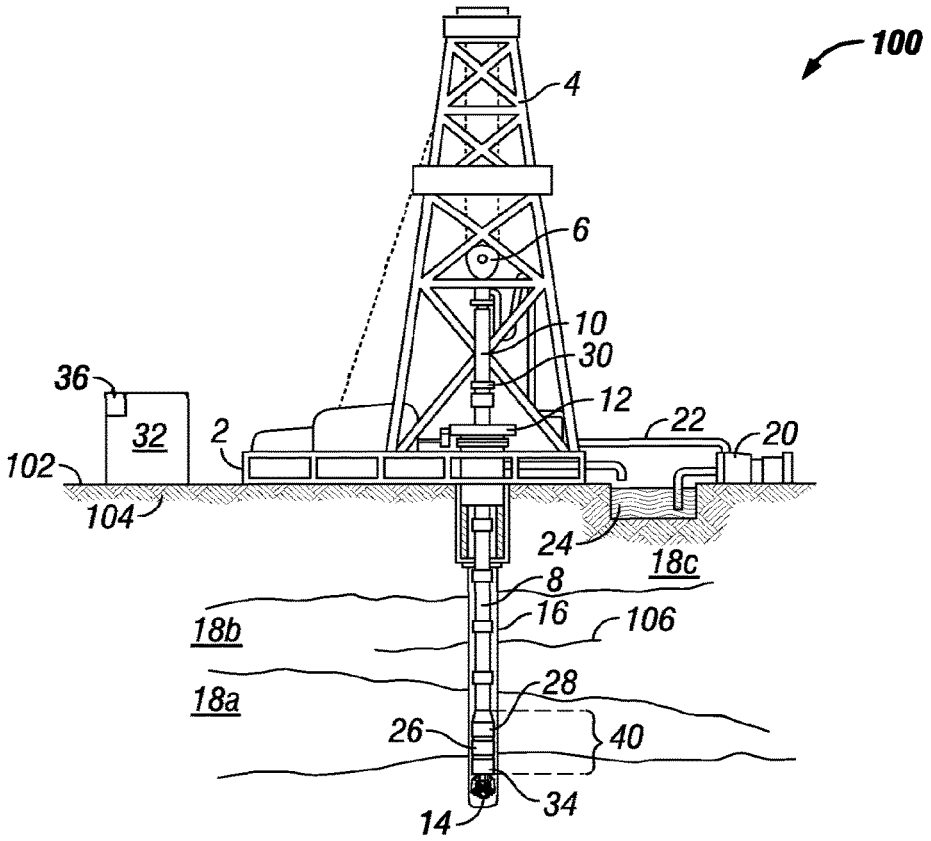
FIG. 1 is a diagram showing an illustrative logging while drilling environment, according to aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to well drilling operations and, more particularly, to analyzing, monitoring, detecting or otherwise evaluating the status of a drilling operation.

During the drilling of a wellbore, an individual bit run contains sensor surveys collected over a limited range of inclinations. In a build section of a wellbore, the inclination can vary from zero degrees (vertical) to ninety degrees (horizontal). For tangent sections of a well, the inclination may only vary by +/−five degrees. Unlike other inventions, the present disclosure enables determination of the bias and gain errors of sensor measurements in both build, tangent and horizontal sections of a wellbore. With the errors determined, corrections can be applied to subsequent directional surveys that are acquired. One or more operators at the surface can also be alerted that the previous surveys have a larger than normal potential error.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, read only memory (ROM), or any other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. It may also include one or more interface units capable of transmitting one or more signals to a controller, actuator, or like device.

For the purposes of this disclosure, computer-readable media may include any instrumentality or aggregation of instrumentalities that may retain data, instructions, or both for a period of time. Computer-readable media may include, for example, without limitation, storage media such as a direct access storage device (for example, a hard disk drive or floppy disk drive), a sequential access storage device (e.g., a tape disk drive), compact disk, compact disk ROM (CD-ROM), DVD, RAM, ROM, electrically erasable programmable read-only memory (EEPROM), flash memory, or any combination thereof; as well as communications media such wires, optical fibers, microwaves, radio waves, and other electromagnetic or optical carriers, or any combination of the foregoing.

Illustrative embodiments of the present disclosure are described in detail herein. In the interest of clarity, not all features of an actual implementation may be described in this specification. It will of course be appreciated that in the development of any such actual embodiment, numerous implementation-specific decisions are made to achieve the specific implementation goals, which will vary from one implementation to another. Moreover, it will be appreciated that such a development effort might be complex and time-consuming, but would, nevertheless, be a routine undertaking for those of ordinary skill in the art having the benefit of the present disclosure.

To facilitate a better understanding of the present disclosure, the following examples of one or more embodiments are given. In no way should the following examples be read to limit, or define, the scope of the invention. Embodiments of the present disclosure may be applicable to horizontal, vertical, deviated, or otherwise nonlinear wellbores in any type of subterranean formation. Embodiments may be applicable to injection wells as well as production wells, including hydrocarbon wells. Embodiments may be implemented using a tool that is made suitable for testing, retrieval and sampling along sections of the formation. Embodiments may be implemented with tools that, for example, may be conveyed through a flow passage in tubular string or using a wireline, slickline, coiled tubing, downhole robot or the like. "Measurement-while-drilling" ("MWD") is the term generally used for measuring conditions downhole concerning the movement and location of the drilling assembly while the drilling continues. "Logging-while-drilling" ("LWD") is the term generally used for similar techniques that concentrate more on formation parameter measurement. Devices and methods in accordance with one or more embodiments may be used in one or more of wireline (including wireline, slickline and coiled tubing), downhole robot, MWD, and LWD operations.

The terms "couple" or "couples" as used herein are intended to mean either an indirect or a direct connection. Thus, if a first device couples to a second device, that connection may be through a direct connection or through an indirect mechanical or electrical connection via other devices and connections. Similarly, the term "communicatively coupled" as used herein is intended to mean either a direct or an indirect communication connection. Such connection may be a wired or wireless connection such as, for example, Ethernet or local area network (LAN). Such wired and wireless connections are well known to those of ordinary skill in the art and will therefore not be discussed in detail herein. Thus, if a first device communicatively couples to a second device, that connection may be through a direct connection, or through an indirect communication connection via other devices and connections.

FIG. 1 is a diagram of a subterranean drilling system 100, according to aspects of the present disclosure. The drilling system 100 comprises a drilling platform 2 positioned at the surface 102. In the embodiment shown, the surface 102 comprises the top of a formation 104 containing one or more rock strata or layers 18*a*, 18*b* and 18*c*, and the drilling platform 2 may be in contact with the surface 102. In other embodiments, such as in an off-shore drilling operation, the surface 102 may be separated from the drilling platform 2 by a volume of water.

The drilling system 100 comprises a derrick 4 supported by the drilling platform 2 and having a traveling block 6 for raising and lowering a drill string 8. A kelly 10 may support the drill string 8 as it is lowered through a rotary table 12. A drill bit 14 may be coupled to the drill string 8 and driven by a downhole motor 26, rotation of the drill string 8 by the rotary table 12, or both. As bit 14 rotates, it creates a borehole 16 that passes through one or more rock strata or layers 18. A pump 20 may circulate drilling fluid through a feed pipe 22 to kelly 10, downhole through the interior of drill string 8, through orifices in drill bit 14, back to the surface via the annulus around drill string 8, and into a retention pit 24. The drilling fluid transports cuttings from the borehole 16 into the pit 24 and aids in maintaining integrity of the borehole 16.

The drilling system 100 may comprise a bottom hole assembly (BHA) 40 coupled to the drill string 8 near the drill bit 14. The BHA 40 may comprise the downhole motor 26, and various downhole measurement tools and sensors and LWD and MWD elements. The downhole motor 26 may comprise at least one transmitter and receiver capable of communicating with adjacent, coupled, proximate or otherwise accessible tool electronics located on the drill string 8. In one or more embodiments, the orientation and position of the bit, the downhole motor 26 or both may be tracked using, for example, an azimuthal orientation indicator, which may include magnetometers, inclinometers, accelerometers or any combination thereof, though other sensor types such as gyroscopes may be used in some embodiments. In one or more embodiments, the downhole motor 26 may comprise a turbine motor, as will be described below.

In one or more embodiments, the downhole motor 26 may also include a control unit (not shown) coupled to transmitters and receivers. The control unit may solely or in combination with other components or devices control one or more operations of any one or more transmitters, receivers, downhole motor 26, or any combination thereof. In one or more embodiments, the one or more operations may comprise storing one or more measurements, receiving one or more measurements, processing, analyzing or any combination thereof rotation information from the downhole motor 26, or any other operation known to one of ordinary skill in the art. Example control units may include microcontrollers and microcomputers and any other device that contains at least one processor communicably coupled to memory devices containing a set of instructions that when executed by the processor, cause it to perform certain actions. In one or more embodiments, a control unit of the downhole motor 26 may be communicably coupled to other controllers within the BHA 40.

The BHA 40 also includes an inclination sensor 34, which may measure the inclination changes to the inclination of the BHA 40, or both, as discussed herein. The inclination sensor 34 may be located downhole or uphole of the motor 26. Example steering tools include point-the-bit and push-the-bit type systems. One use of the inclination sensor 34 is to provide borehole geometry information to aid drilling operations. The inclination sensor 34 may generate accelerometer measurements. In one or more embodiments, the accelerometer measurements may be used in combination with other sensor measurements to determine the location, position, geometry, or any combination thereof of the borehole while drilling. In one or more embodiments, the inclination sensor 34 may provide accelerometer measurements for a borehole after it is drilled. The inclination sensor 34 may be positioned in the lower end of the drilling system 100, and may be proximate to the drill bit 14.

The tools and sensors of the BHA 40 including the inclination sensor 34 may be communicably coupled to a telemetry element or device 28. Telemetry element 28 may comprise a transmitter. The telemetry element 28 may transfer measurements from the downhole motor 26 to a surface receiver 30 receive commands from the surface receiver 30, or both. For example, the telemetry element 28 may relay accelerometer measurements as they are received from the inclination sensor 34 (for example, in real-time) to the surface 102, for example, to information handling system 32, for processing. In one or more embodiments, the telemetry element 28 may comprise a mud pulse telemetry system, acoustic telemetry system, wired communications system, wireless communications system, or any other type of communications system that would be appreciated by one of ordinary skill in the art in view of this disclosure. In one or more embodiments, some or all of the measurements taken with the inclination sensor 34 may be stored within the inclination sensor 34, the telemetry element 28, or any other electronic component of the BHA 40 for later retrieval at the surface 102.

In one or more embodiments, the drilling system 100 may comprise an information handling system 32 positioned at the surface 102. In one or more embodiments, information handling system 32 is located remote from the drilling system 100. The information handling system 32 may be communicably coupled to the surface receiver 30 and may receive measurements from the inclination sensor 34, transmit commands, or both to the downhole motor 26 though the surface receiver 30. The information handling system 32 may also receive measurements from the inclination sensor 34 when retrieved at the surface 102. In one or more embodiments, the information handling system 32 may process the accelerometer measurements to determine an orientation, an inclination, or both of the BHA 40 and corresponding borehole 16. In one or more embodiments, information handling system 32 comprises a display 36 for display of the one or more measurements received or other information based on the one or more measurements received.

Figure 2:
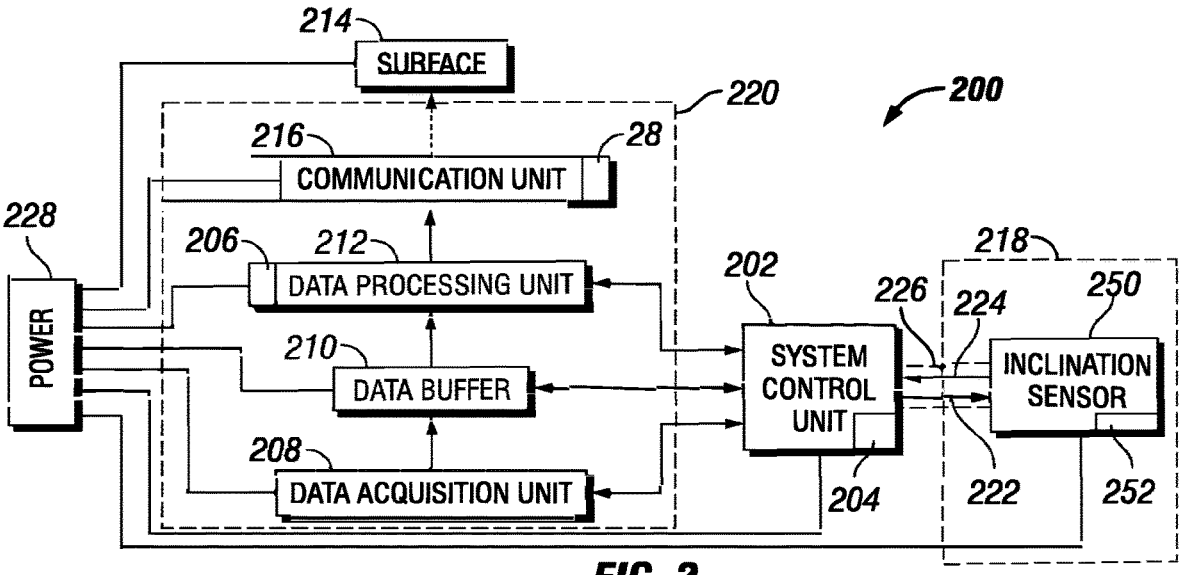
FIG. 2 is a diagram of an example control system for a drilling system comprising an inclination sensor, according to aspects of the present disclosure.

In one or more embodiments, a control system associated with a downhole tool may control when and how a logging system captures measurements. FIG. 2 is a diagram of an example control system 200 for a downhole tool 218. Downhole tool 218 may comprise one or more inclination sensors 250 communicatively, directly, indirectly, or otherwise coupled to the system control unit 202. In one or more embodiments, control system 200 or any one or more components of control system 200 may comprise an information handling system, such as information handling system 600 of FIG. 6. In one or more embodiments, downhole tool 218 may comprise any one or more of system control unit 202, electronics package 220, power 228, or any other suitable component or device.

In one or more embodiments, the system control unit 202 may trigger the inclination sensor 250 to obtain or transmit one or more measurements 224. The one or more measurements 224 may comprise one or more inclination measurements, one or more orientation measurements, or both using a control signal 222. In one or more embodiments, the system control unit 202 may send one or more control signals 222 to the inclination sensor 250. The one or more control signals may instruct the inclination sensor 250 when, how often or both to obtain one or more measurements from the inclination sensor 250, to communicate or transmit the one or more measurements to the system control unit 202, any other suitable command, or any combination thereof. In one or more embodiments, the inclination sensor 250 may comprise one or more accelerometers or a set of accelerometers that measure acceleration of the inclination sensor 250, for example, as illustrated in FIGS. 3A, 3B, 3C, and 3D, 4A and 4B, 5A, 5B, 5C, and 5D and that communicate or transmit one or more measurements 224 to the system control unit 202. In one or more embodiments, the one or more measurements 224 obtained and communicated by the inclination sensor 250 may provide information regarding the orientation, inclination, or both of the inclination sensor 250, which in turn may provide information regarding the geometry and position of a wellbore, for example, borehole 16 of FIG. 1, that the inclination sensor 250 is located within. In one or more embodiments, the inclination sensor 250 comprises a memory 252 for storing the one or more measurements 224.

The system control unit 202 may be coupled to the inclination sensor 250 by one or more communication links 226. Communications link 226 may comprise a cable, line, wire, or other communications coupling device or may be wireless. Communications link 226 may couple any one or more accelerometers of inclination sensor 250 to system control unit 202. System control unit 202 may receive one or more measurements 224 from the inclination sensor 250, and may transmit the one or more measurements 224 to the data acquisition unit 208. Upon reception at the data acquisition unit 208, the one or more measurements 224 may be digitized, stored in a data buffer 210, communicated to the data processing unit 212 for processing, sent to the surface 214 or other downhole receiver through a communication unit 216. In one or more embodiments, communication unit 216 may comprise a downhole telemetry system, for example telemetry element 28, or any combination thereof.

Figure 6:
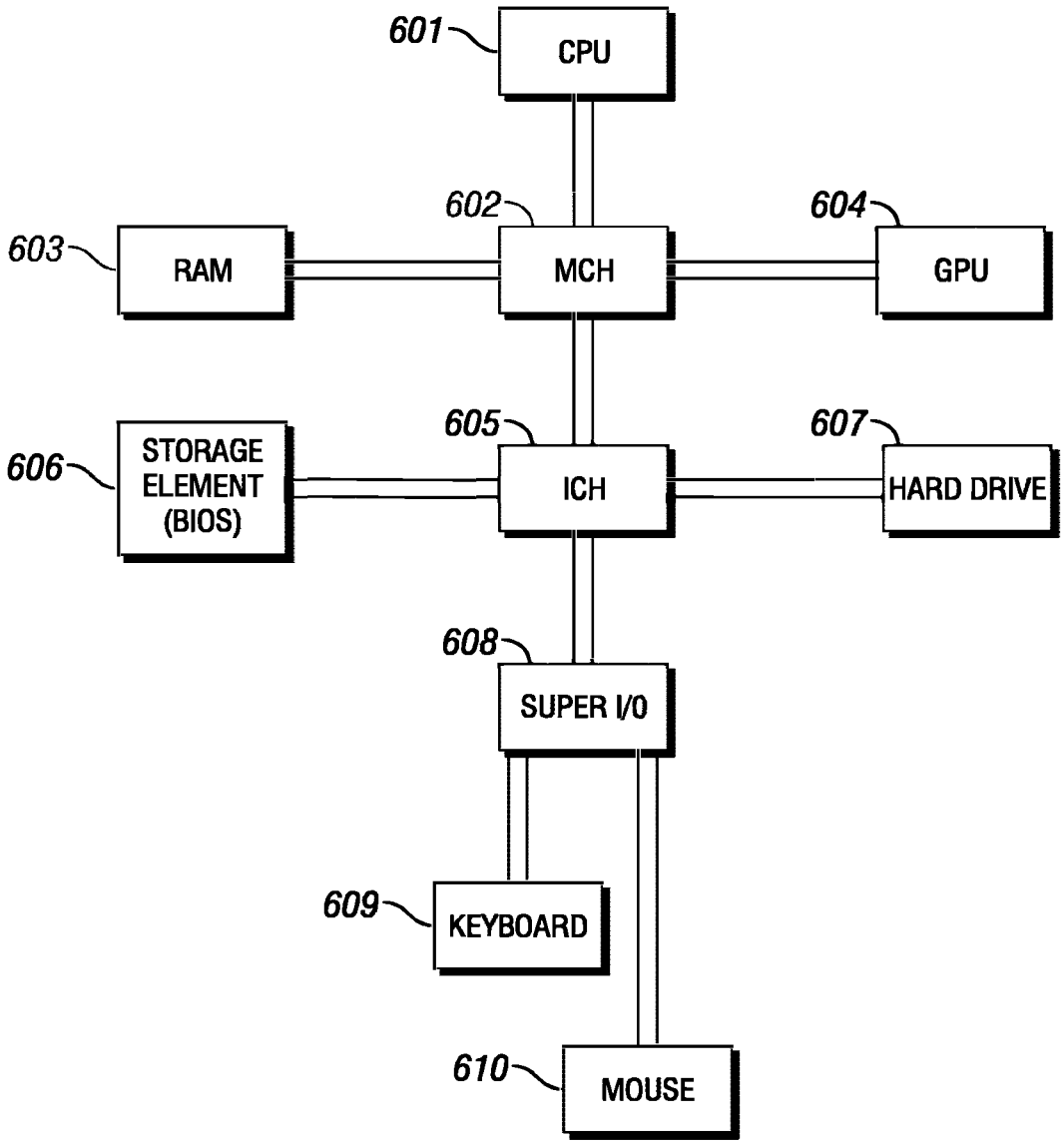
FIG. 6 is a diagram of an example information handling system, according to aspects of the present disclosure.

In one or more embodiments, the data acquisition unit 212 may comprise an information handling system, for example, an information handling system 600 of FIG. 6. The data processing unit 212 may comprise a processor 206 that executes one or more instructions for processing the one or more measurements 224. The data processing unit 212 may process the one or more measurements 224 according to any one or more algorithms, functions, or calculations discussed below. In one or more embodiments, the data processing unit 212 may output a calculated inclination of the inclination sensor 250 or a downhole tool 218, for example, BHA 40 of FIG. 1, based, at least in part, on the one or more measurements 224. The calculated inclination may be communicated to the surface 214 via the communication unit 216 or telemetry device 28.

The system control unit 202 may include one or more instructions, for example, one or more instructions executable by a processor 204, that control or otherwise alter the operation of the inclination sensor 250. In one or more embodiments, one or more control signals 222 to the inclination sensor 250 may be generated based, at least in part, on the one or more executed instructions.

In one or more embodiments, the control system 200 comprises a power source 228, for example, a battery. Power source 228 supplies power to any one or more of the inclination sensor 250 (and accordingly, any one or more accelerometers of inclination sensor 250), system control unit 202, data acquisition unit 208, data buffer 210, data processing unit 212 and communication unit 216. In one or more embodiments, power source 228 may comprise a plurality of power sources disposed or positioned at any location proximate to any one or more components of the control system 200.

According to aspects of the present disclosure, the one or measurements 224 from the inclination sensor 250 of the downhole tool may be aggregated and processed to produce a visualization of one or more downhole elements. In one or more embodiments, aggregating and processing the one or more measurements 224 may comprise aggregating and processing the one or more measurements 224 using a control unit located either within the downhole tool 218, for example, by data processing unit 212, or at the surface 214 above the downhole tool 218, for example, by information handling system 32 of FIG. 1. When processed at the surface, the one or more measurements 224 may be communicated to the surface 214 in real time, such as through a wireline, mud pulse, or electromagnetic telemetry data connection, or stored in a downhole tool 218 and later processed when the downhole tool 218 is retrieved to the surface. In one or more embodiments, aggregating and processing the one or more measurements 224 may comprise aggregating and processing the one or more measurements 224 using an error correction algorithm implemented as a set of instructions in the control unit that are executable by a processor of the control unit to perform data calculations and manipulations necessary for the error correction algorithm.

Figure 3A:
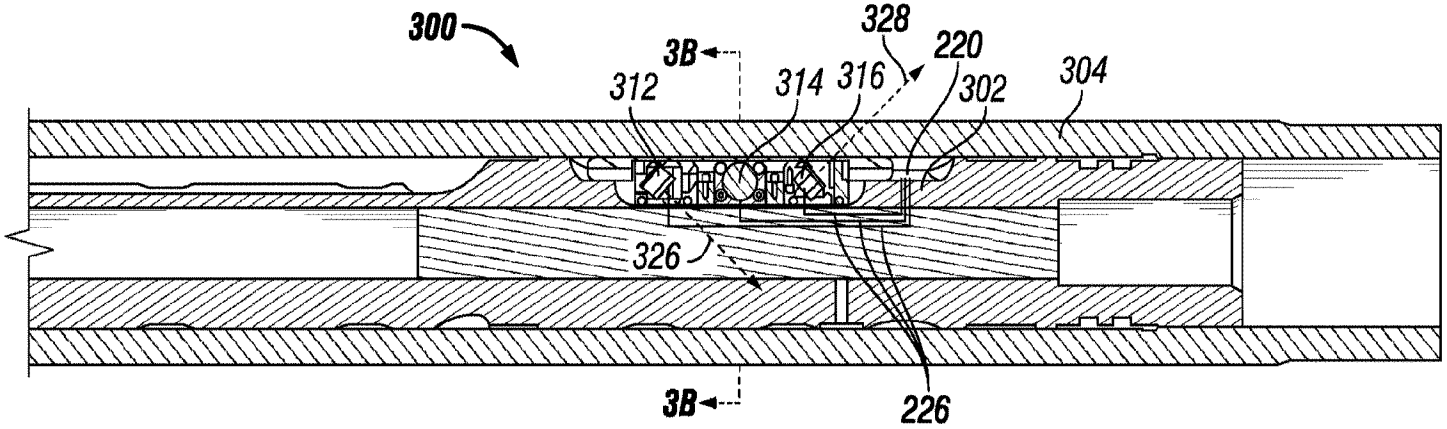
FIG. 3A is a diagram of an example inclination sensor comprising a set of three accelerometers mounted on an insert inside a drill collar, according to aspects of the present disclosure.
Figure 3B:
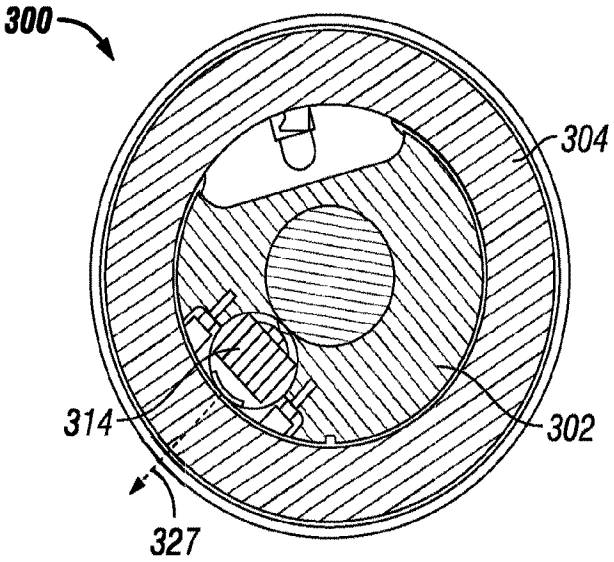
FIG. 3B is diagram of an example inclination sensor comprising a set of three accelerometers mounted on an insert inside a drill collar, as shown from view 3B, according to aspects of the present disclosure.

Referring now to FIG. 3A an embodiment of the inclination sensor 300 is shown comprising a sensor body 302 disposed within a drill collar 304, while FIG. 3B shows the inclination sensor 300 embodiment of FIG. 3A from view 3B. In one or more embodiments, the inclination sensor 300 may comprise a first accelerometer 312, a second accelerometer 314, and a third accelerometer 316, each positioned, disposed, or otherwise mounted on, within or about the sensor body 302. Together, the first, second, and third accelerometers 312, 314, 316 may be referred to as a set of accelerometers. In one or more embodiments, the accelerometers 312, 314, 316 may be spaced along the length of the sensor body 302. For example, the second accelerometer 314 may be disposed downhole of the first accelerometer 312, and the third accelerometer 316 may be disposed downhole of the second accelerometer 316. In one or more embodiments, the set of accelerometers, for example, accelerometers 312, 314, and 316, may be coupled to an electronics package 220 as illustrated in FIG. 2 via one or more communication links 226. In one or more embodiments, communication link 226 may comprise a single communication link or may comprise a plurality of communication links. The electronics package 220, for example, as shown in FIG. 2, may comprise a telemetry device or telemetry element, such as telemetry element 28 of FIG. 1. The telemetry element 28 may receive one or more measurements from at least one of the accelerometers of the set of accelerometers 312, 314,316.

Each of the accelerometers 312, 314, 316 may be oriented at a separate angle from each other. For example, the first accelerometer 312 may have a first measurement axis 326, the second accelerometer 314 may have a second measurement axis 327 (as illustrated in FIG. 3B), and the third accelerometer 316 may have a third measurement axis 328. In one or more embodiments, the accelerometers 312, 314, 316 may be orthogonal to one another.

The orientations or measurement axis of the first accelerometer 312, second accelerometer 314, and third accelerometer 316 may each be out of alignment with the longitudinal axis of the inclination sensor body 302. In other words, in one or more embodiments, each of the measurement axes 326, 327, 328 of the accelerometers 312, 314, 316 are not aligned with the longitudinal axis of the inclination sensor body 302. The inclination sensor body 302 may be parallel to but offset from the longitudinal axis of the wellbore, for example, borehole 16 of FIG. 1. As such, each of the three accelerometers 312, 314, and 316 would be out of alignment with the longitudinal axis of the wellbore. Additionally, the three accelerometers 312, 314, 316 are oriented such that the measurement axes 326, 327, 328 of the three accelerometers 312, 314, 316 are each at or about ten degrees or more from the direction of the wellbore, for example, borehole 16 of FIG. 1. In one or more embodiments, each of the three accelerometers 312, 314, and 316 may be oriented such that the measurement axis associated with each of the accelerometers 312,314, and 316 is not in alignment with the longitudinal axis of the drill string or wellbore. In one or more embodiments, a fourth accelerometer (not shown) may have a measurement axis aligned with the longitudinal axis of the wellbore. An embodiment with four accelerometers may be more tolerant to drilling noise, and may provide a quality assured inclination reading, by using the measurements from the three misaligned accelerometers to check the fourth accelerometer when drilling is paused. In one or more embodiments, the longitudinal axis of the inclination sensor body 302 may correspond to the longitudinal axis of the BHA, the longitudinal axis of the drill string, or both.

Figure 4A:
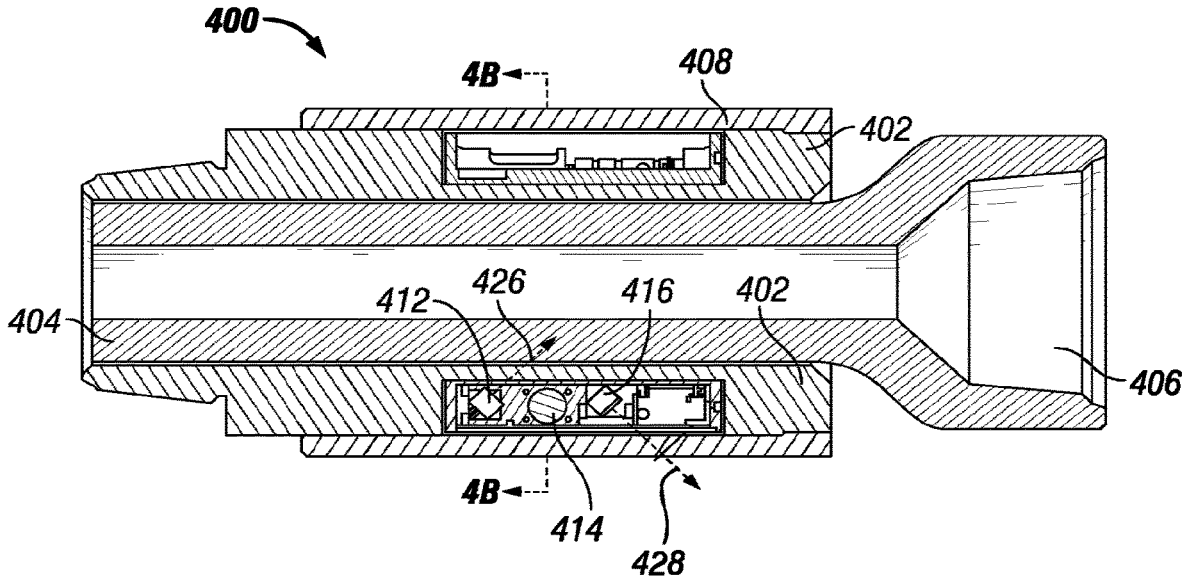
FIG. 4A is a diagram of an example inclination sensor comprising a set of three accelerometers mounted on a clam shell, according to aspects of the present disclosure.
Figure 4B:
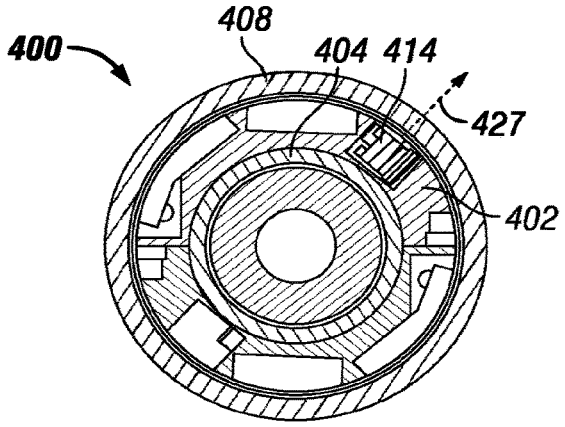
FIG. 4B is a diagram of an example inclination sensor comprising a set of three accelerometers mounted on a clam shell, as shown from view 4B, according to aspects of the present disclosure.

Referring now to FIG. 4A, an embodiment of the inclination sensor 400 comprising a sensor body 402 disposed within a clam shell 408 mounted on a drill string 404 and proximate to a drill bit 406. FIG. 4B shows the inclination sensor 400 embodiment of FIG. 4A from view 4B. In one or more embodiments, the inclination sensor 400 may comprise a first accelerometer 412, a second accelerometer 414, and a third accelerometer 416, each mounted on the sensor body 402. Together, the first, second, and third accelerometers 412, 414, 416 may be referred to as a set of accelerometers. In one or more embodiments, the first, second, and third accelerometers 412, 414, 416 may be spaced or distributed along the length of the inclination sensor body 402. For example, the second accelerometer 414 may be disposed downhole of the first accelerometer 412, and the third accelerometer 416 may be disposed downhole of the second accelerometer 414.

Each of the first, second, and third accelerometers 412, 414, 416 may have a separate orientation angle or measurement axis. For example, the first accelerometer 412 may have a first measurement axis 426, the second accelerometer 414 may have a second measurement axis 427 (as illustrated in FIG. 4B), and the third accelerometer 416 may have a third measurement axis 428. In one or more embodiments, the first, second, and third accelerometers 412, 414, 416 may be orthogonal to one another.

The orientations of the first accelerometer 412, second accelerometer 414, and third accelerometer 416 may each be out of alignment with the sensor body 402. In one or more embodiments, each of the measurement axes 426, 427, 428 of the first, second, and third accelerometers 412, 414, 416 are not aligned with the sensor body 402. For example, the sensor body 402 may be parallel to, but offset from the longitudinal axis of the drill string or the wellbore, for example, borehole 16 of FIG. 1. As such, each accelerometer of the set of accelerometers may be out of alignment with the longitudinal axis of the drill string or the wellbore. Additionally, any one or more of the set of accelerometers 412, 414, 416 may be oriented such that the measurement axes 426, 427, 428 of the set of accelerometers 412, 414, 416 are each at or about ten degrees or more from the longitudinal axis of the drill string or the wellbore, for example, borehole 16 of FIG. 1. In one or more embodiments, each of the set of accelerometers 412, 414, and 416 may be oriented such that a measurement axis associated with each of the first, second, and third accelerometers 412, 414, 416 is not aligned with a longitudinal axis of the wellbore. In one or more embodiments, a fourth accelerometer (not shown) may have a measurement axis aligned with the longitudinal axis of the wellbore. An embodiment with four accelerometers may be more tolerant to drilling noise, and could provide a quality assured inclination reading, by using the measurements from the three misaligned accelerometers to check the fourth accelerometer when drilling is paused. In one or more embodiments, the longitudinal axis of the sensor body 402 may correspond to the longitudinal axis of the BHA, the longitudinal axis of the drill string, or both.

Figure 5A:
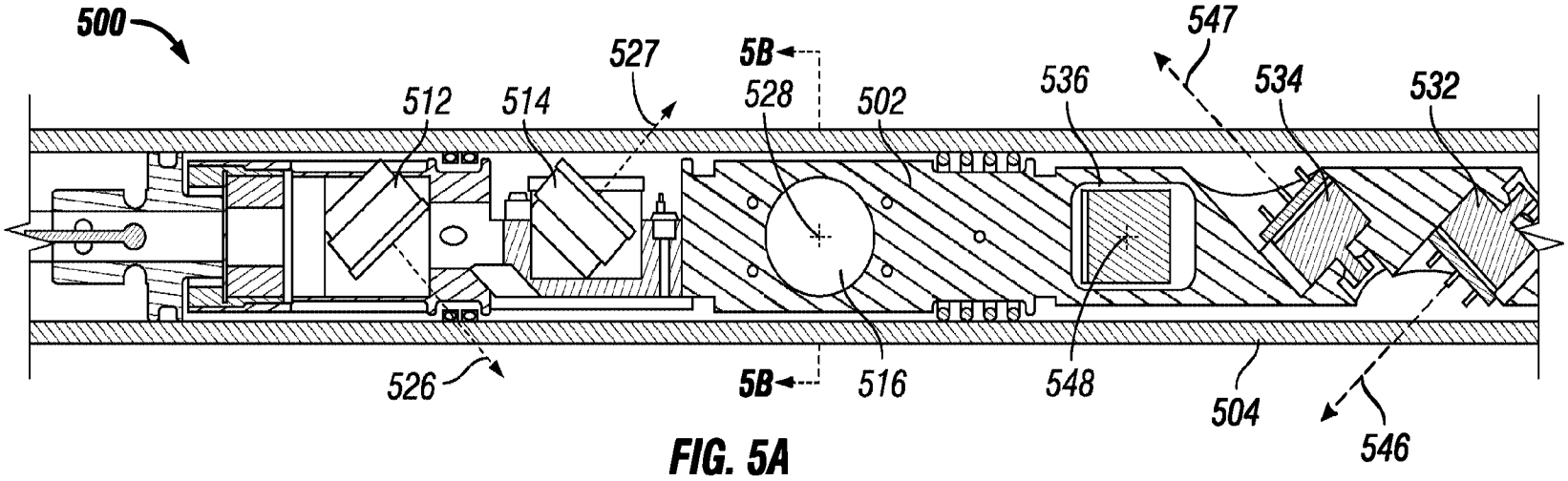
FIG. 5A is a diagram of an example inclination sensor comprising a set of three accelerometers mounted on a sonde, according to aspects of the present disclosure.
Figure 5B:
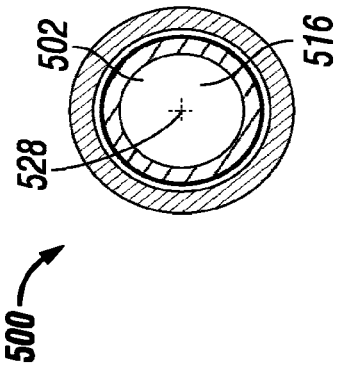
FIG. 5B is a diagram of an example inclination sensor comprising a set of three accelerometers mounted on a sonde, as shown from view 5B, according to aspects of the present disclosure.
Figure 5C:
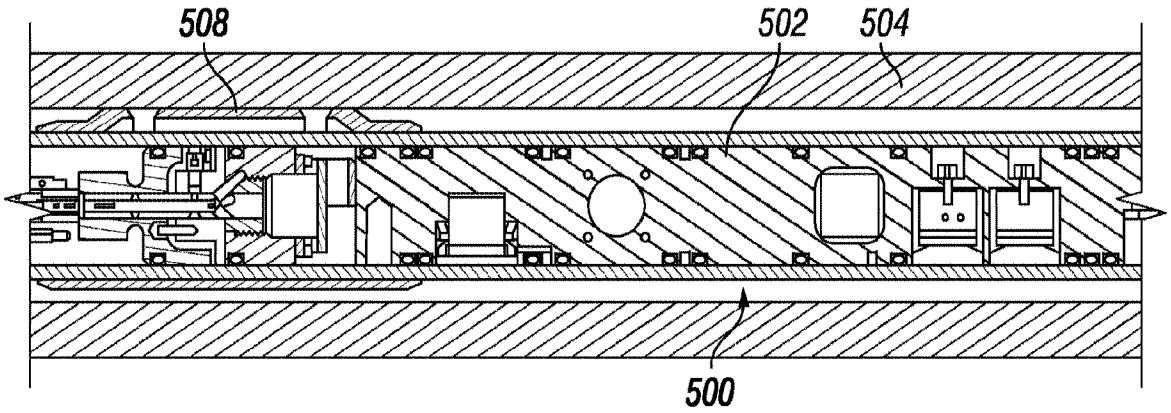
FIG. 5C is a diagram of an example inclination sensor comprising a set of three accelerometers mounted on a sonde, according to aspects of the present disclosure.

Referring now to FIG. 5A an embodiment of the inclination sensor 500 is shown comprising a sensor body 502, for example, a sonde sensor body, disposable within a collar. As an example, FIG. 5C shows the sensor body 502 disposed within a collar 504, where the sensor body 502 comprises a centralizer 508 engaging an inner surface of the collar 504. FIG. 5B shows the inclination sensor 500 embodiment of FIG. 5A from view 5B. Referring back to FIG. 5A, in one or more embodiments, the inclination sensor 500 may comprise a first accelerometer 512, a second accelerometer 514, and a third accelerometer 516, each mounted on the sensor body 502. Together, the first, second, and third accelerometers 512, 514, 516 may be referred to as a set of accelerometers. In one or more embodiments, the first, second, and third accelerometers 512,514, 516 may be axially disposed along the length of the sensor body 502. For example, the second accelerometer 514 may be disposed downhole of the first accelerometer 512, and the third accelerometer 516 may be disposed downhole of the second accelerometer 516.

The set of accelerometers 512, 514, 516 may be disposed on or about the inclination sensor 500 such that each accelerometer has a distinct orientation or measurement axis. For example, the first accelerometer 512 may have a first measurement axis 526, the second accelerometer 514 may have a second measurement axis 527, and the third accelerometer 516 may have a third measurement axis 528. In one or more embodiments, the first, second, and third accelerometers 512, 514, 516 may be orthogonal to one another.

The orientations of the first accelerometer 512, second accelerometer 514, and third accelerometer 516 may each be out of alignment with the sensor body 502. In other words, in one or more embodiments, each of the accelerometers 512, 514, 516 are not aligned with the sensor body 502. For example, the sensor body 502 may be parallel to but offset from the longitudinal axis of the drill string or wellbore, for example, borehole 16 of FIG. 1. The three accelerometers are oriented such that their measurement axes are each at or about ten degrees or more from the direction of the wellbore, for example, borehole 16 of FIG. 1. In one or more embodiments, each of the three accelerometers 512, 514, and 516 may be oriented such that the measurement axis associated with each of the accelerometers 512, 514, and 516 is not in alignment with the longitudinal axis of the drill string or wellbore.

In one or more embodiments, the inclination sensor 500 may comprise a first magnetometer 532, a second magnetometer 534, and a third magnetometer 536. The first, second, and third magnetometers 532, 534, 536 may collectively be referred to as a set of magnetometers. In one or more embodiments, the magnetometers 532, 534, 536 may be axially disposed along the length of the sensor body 502. For example, the first magnetometer 532 may be disposed downhole of the second magnetometer 532, and the second magnetometer 534 may be disposed downhole of the third magnetometer 536.

The set of magnetometers 532, 534, 536 may be disposed on or about the inclination sensor 500 such that each magnetometer has a distinct orientation or measurement axis. For example, the first magnetometer 532 may have a first measurement axis 546, the second magnetometer 534 may have a second measurement axis 547, and the third magnetometer 536 may have a third measurement axis 548.

The orientations of the first magnetometer 532, second magnetometer 534, and third magnetometer 536 may each be out of alignment with the sensor body 502. In other words, in one or more embodiments, each of the first, second, and third magnetometers 532, 534, 536 are not aligned with the sensor body 502. For example, the sensor body 502 may be parallel to but offset from the longitudinal axis of the drill string or wellbore, for example, borehole 16 of FIG. 1. The set of magnetometers may be oriented such that each measurement axis associated with each of the magnetometers 532, 534, 536 is at or about ten degrees or more from the direction of the wellbore, for example, borehole 16 of FIG. 1. In one or more embodiments, each of the first, second, and third magnetometers 532, 534, and 536 may be oriented such that the measurement axis associated with each of the first, second and third magnetometers 532, 534, and 536 is not in alignment with the longitudinal axis of the drill string or wellbore. In one or more embodiments, the first magnetometer 532 and the second magnetometer 534 may have measurement axes at the same angle from the longitudinal axis of the drill string or wellbore, for example drill string 8 or borehole 16, respectively, as shown in FIG. 1. In one or more embodiments, as shown by example in FIG. 5A, measurement axes 546 and 547 of first and second magnetometers 532 and 534 may each be 45 degrees from the longitudinal axis of the drill string or wellbore. In one or more embodiments, measurement axis 548 of the third magnetometer 536 may be orthogonal to the longitudinal axis of the drill string or wellbore.

Data obtained from magnetometers, for example, three axis magnetometer data, may be used to determine magnetic bearing when combined with the pitch and roll angles calculated from accelerometer data. In one or more embodiments, the set of magnetometers 532, 534, and 536 may be used in addition to the set of accelerometers 512, 514, and 516. Measurements or data from the set of magnetometers 532, 534, and 536 may be combined with measurements or data from the set of accelerometers 512, 514, and 516 to determine the northings and eastings for the length of the borehole. The arrangement of the set of accelerometers, magnetometers, or both allows the bias and gain errors for each sensor to be calculated (discussed below). With corrected measurements, the subsequent determination or calculation of the borehole orientation or inclination is more accurate.

Figure 5D:
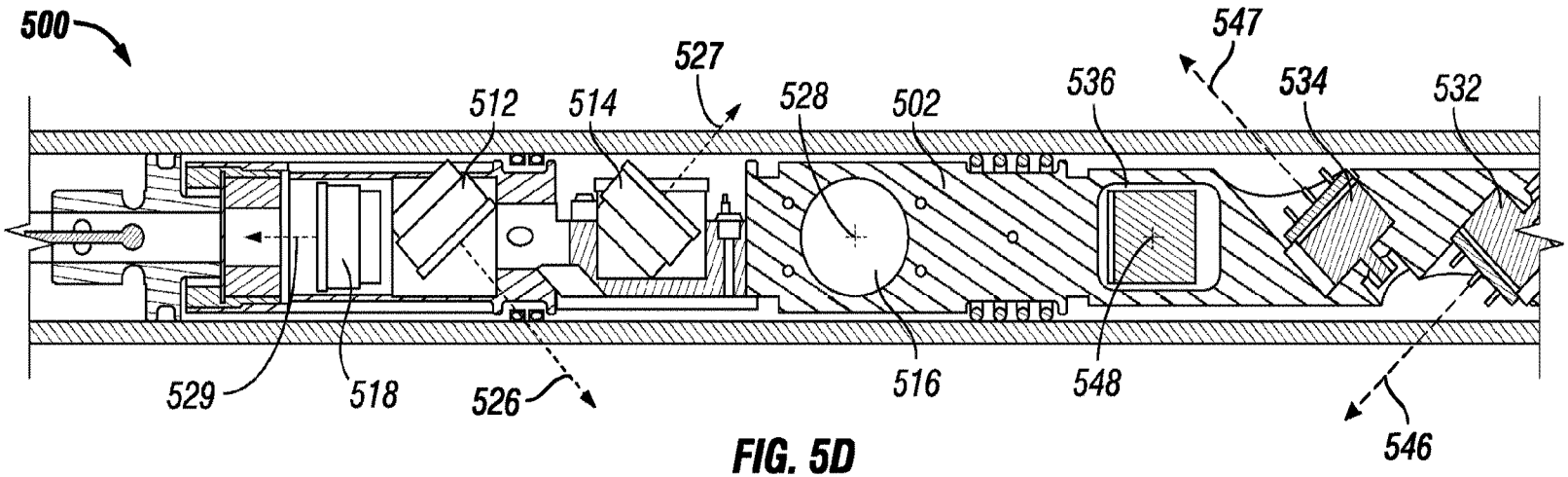
FIG. 5D is a diagram of an example inclination sensor comprising a set of four accelerometers mounted on a sonde, according to aspects of the present disclosure.

In one or more embodiments, a fourth accelerometer 518 may be disposed on the inclination sensor 500 as shown in FIG. 5D. The accelerometers 512, 514, 516, and 518 may be collectively referred to as a set of accelerometers. The fourth accelerometer 518 may have a measurement axis 529 aligned with the longitudinal axis of the drill string or wellbore, for example, borehole 16 of FIG. 1. As discussed above, the set of accelerometers may be coupled to an electronics package that includes a telemetry device, such as electronics package 220 of FIG. 3A and telemetry element 28 of FIG. 1. The telemetry device may receive one or more measurements from at least one of the accelerometers of the set of accelerometers. A design with four accelerometers may be more tolerant to drilling noise, and could provide a quality assured inclination reading, by using the measurements from the three misaligned accelerometers, for example, the first, second, and third accelerometers 512, 514, and 516, to verify accuracy of measurements from the fourth accelerometer, for example, fourth accelerometer 518, when drilling is paused or otherwise stopped, for example, when rotation of the drill bit ceases, logging operations are paused, or power to the drill bit is terminated. In one or more embodiments, measurements or data from the fourth accelerometer 518 may be used to determine inclination in the horizontal sections of the wellbore. The measurements associated with the fourth accelerometer may be particularly useful in high vibration scenarios. The measurements of the fourth accelerometer 518 may be quality checked by comparing previous measurements of the fourth accelerometer 518 when drilling is paused or otherwise stopped. For example, vibration during drilling is typically higher in the plane that is perpendicular to the borehole axis (cross-axial). In high vibration conditions or scenarios, a fourth accelerometer aligned along the borehole axis provides inclination measurements in the horizontal and build sections of the wellbore. In one or more embodiments, the longitudinal axis of the sensor body 502 may correspond to the longitudinal axis of the BHA, the longitudinal axis of the drill string or both Each accelerometer discussed may be capable of measuring gravitational force, acceleration, or both exerted on the accelerometer in the direction the accelerometer is oriented. In one or more embodiments, the accelerometer does not measure force or acceleration in any other direction.

FIG. 6 is a diagram illustrating an example information handling system 600, according to one or more aspects of the present disclosure. The information handling system 32 of FIG. 1 and any component discussed that includes a processor may take a form similar to the information handling system 600 or include one or more components of information handling system 600. A processor or central processing unit (CPU) 601 of the information handling system 600 is communicatively coupled to a memory controller hub (MCH) or north bridge 602. The processor 601 may include, for example a microprocessor, microcontroller, digital signal processor (DSP), application specific integrated circuit (ASIC), or any other digital or analog circuitry configured to interpret, execute program instructions, process data, or any combination thereof. Processor (CPU) 601 may be configured to interpret and execute program instructions or other data retrieved and stored in any memory such as memory 603 or hard drive 607. Program instructions or other data may constitute portions of a software or application for carrying out one or more methods described herein. Memory 603 may include read-only memory (ROM), random access memory (RAM), solid state memory, or disk-based memory. Each memory module may include any system, device or apparatus configured to retain program instructions, program data, or both for a period of time (e.g., computer-readable non-transitory media). For example, instructions from a software or application may be retrieved and stored in memory 603 for execution by processor 601.

Modifications, additions, or omissions may be made to FIG. 6 without departing from the scope of the present disclosure. For example, FIG. 6 shows a particular configuration of components of information handling system 600. However, any suitable configurations of components may be used. For example, components of information handling system 600 may be implemented either as physical or logical components. Furthermore, in some embodiments, functionality associated with components of information handling system 600 may be implemented in special purpose circuits or components. In other embodiments, functionality associated with components of information handling system 600 may be implemented in configurable general purpose circuit or components. For example, components of information handling system 600 may be implemented by configured computer program instructions.

Memory controller hub (MCH) 602 may include a memory controller for directing information to or from various system memory components within the information handling system 600, such as memory 603, storage element 606, and hard drive 607. The memory controller hub 602 may be coupled to memory 603 and a graphics processing unit (GPU) 604. Memory controller hub 602 may also be coupled to an I/O controller hub (ICH) or south bridge 605. I/O controller hub 605 is coupled to storage elements of the information handling system 600, including a storage element 606, which may comprise a flash ROM that includes a basic input/output system (BIOS) of the computer system. I/O controller hub 605 is also coupled to the hard drive 607 of the information handling system 600. I/O controller hub 605 may also be coupled to a Super I/O chip 608, which is itself coupled to several of the I/O ports of the computer system, including keyboard 609 and mouse 610.

In one or more embodiments, an information handling system 600 may comprise at least a processor and a memory device coupled to the processor that contains a set of instructions that when executed cause the processor to perform certain actions. In any embodiment, the information handling system may include a non-transitory computer readable medium that stores one or more instructions where the one or more instructions when executed cause the processor to perform certain actions. As used herein, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a computer terminal, a network storage device, or any other suitable device and may vary in size, shape, performance, functionality, and price. The information handling system may include random access memory (RAM), one or more processing resources such as a central processing unit (CPU) or hardware or software control logic, read only memory (ROM), or any other types of nonvolatile memory. Additional components of the information handling system may include one or more disk drives, one or more network ports for communication with external devices as well as various I/O devices, such as a keyboard, a mouse, and a video display. The information handling system may also include one or more buses operable to transmit communications between the various hardware components.

Any of the one or more accelerometers or set of accelerometers discussed may be configured, structured, and arranged to detect changes in the inclination of the inclination sensor in any direction. In one or more embodiments, the set of accelerometers may measure a change in inclination of the inclination sensor while rotating, for example, during drilling operations. As such, the inclination sensor may send inclination information or one or more measurements indicative of inclination or orientation via a telemetry device while a borehole is actively being drilled (for example, in real-time). In one or more embodiments, the inclination sensor may send inclination or orientation information or one or more measurements indicative of inclination or orientation via a telemetry device when drilling is stopped or paused.

The one or more measurements received at the surface from the inclination sensor (or one or more accelerometers) may be displayed on a display of an information handling system, for example display 36 of information handling system 32. A drilling operator may alter, adjust, or change drilling parameters such as drill speed, drill orientation or direction, or otherwise adjust the drilling operation in order to maintain a desired inclination or angle for the section of borehole being drilled based, at least in part, on the one or more measurements. For example, a drilling parameter may be altered or adjusted based, at least in part, on a determination of at least one of an inclination, orientation, or both of the downhole tool where the inclination, orientation or both are determined based, at least in part, on one or more accelerometer measurements where at least one of the one or more accelerometer measurements have been corrected for measurement error.

In one or more embodiments, the one or more measurements received from any of the discussed one or more accelerometers may be processed using a processor at the surface, for example, by using information handling system 32 at surface 102 as illustrated in FIG. 1. For example, the processor may create a graph, chart, borehole geometry display, or any other visual representation of the accelerometer measurement data. Visually displaying the inclination measurements may aid the drilling operator to interpret the accelerometer measurements while drilling. In one or more embodiments, visual representations of the accelerometer measurement may be created in real-time while the borehole is being drilled. For example, a visual representation of the real-time inclination of the inclination sensor may be displayed, which may be used as a proximate for the inclination of the associated BHA. As such, accelerometer measurements from the inclination sensor may be used to provide a drilling operator with information necessary for determining a geometry of the borehole.

The borehole geometry, drilling system location, or both may be further informed by measurements obtained by or received from other downhole tools. For example, an information handling system or processor may calculate the drill bit current location and location history to build borehole geometry by combining the inclination measurements with other downhole tool measurements such as magnetometer, gyroscopic, additional accelerometer measurements or any combination thereof. A drilling operator may then alter or change drilling parameters such as drill speed, drill orientation or direction, or otherwise adjust the drilling operation in order to correct for a measured deviation or error from a planned well path of the borehole, and to prevent any further deviation or error from the planned well path.

Each accelerometer measurement may be recorded in a memory or storage location of an information handling system. For example, in one or more embodiments a storage location, storage element, hard drive or other memory may comprise a database to maintain a record of the accelerometer measurements. In one or more embodiments, the record of accelerometer measurements may be stored in a storage location, storage element, hard drive or memory at the inclination sensor. In one or more embodiments, the record of measurements may be stored in a database at the surface. In one or more embodiments, the inclination sensor may maintain a record of accelerometer measurements and the temperature at which the measurement was recorded. For example, the record of measurements may contain each accelerometer measurement recorded by or communicated by the inclination sensor for the life of the inclination sensor, the life of the set of accelerometers, over a defined period (for example, five years), which may be determined by the operator, or any combination thereof.

In one or more embodiments, each accelerometer measurement may be recorded and weighted based on age of the accelerometer measurement. The recorded measurement may be adjusted or weighted based on signal to noise ratio of the measurement, sensor stability, other status indications that may affect the sensor reading or any combination thereof.

The accelerometer measurements may be error corrected, such as by correcting measurement error as discussed below. In one or more embodiments, the measurement error may comprise gain errors, bias errors, or both for each accelerometer. In one or more embodiments, the accelerometer measurements may be error corrected using a least squares fit that estimates the gain error, bias error, or both of each accelerometer.

For example, the accelerometer measurements taken from a set of three accelerometers may be represented as:

$$(G_{total}+\Delta G_{total})^2=(G_x\Delta G_x)^2+(G_y\Delta G_y)^2(G_z\Delta G_z)^2 \quad (1)$$

Where $G_x$, $G_y$, and $G_z$ are the respective accelerations measured in the x, y, and z directions by the accelerometers, and $G_{total}$ represents the sum acceleration measurement. The bias and gain errors associated with each accelerometer measurement is represented by $\Delta G_x$, $\Delta G_y$, and $\Delta G_z$ respectively, and $\Delta G_{total}$ represents the sum of these errors. This measurement error relationship can be rewritten in least squares form as:

$$G_{total}^2+2G_{total}\Delta G_{total}+\Delta G_{total}^2=\Sigma^{i=x,y,z}G_i^2+2G_i\Delta G_i+\Delta G_i^2 \quad (2)$$

$\Delta G_{total}^2$ and $\Delta G_i^2$ are second order terms, so dropping these from equation (2), it simplifies to:

$$G_{total}^2+2G_{total}\Delta G_{total}\approx\Sigma^{i=x,y,z}(G_i^2+2G_i\Delta G_i) \quad (3)$$

With no errors, $$G_{total}^2=\Sigma^{i=x,y,z}G_i^2 \quad (4)$$

Subtracting $G_{total}^2$ from equation (3) yields:

$$G_{total}\Delta G_{total}=\Sigma^{i=x,y,z}G_i\Delta G_i \quad (5)$$

The error $\Delta G_i$ is the sum of the gain error and the bias error, and therefore can be broken out into its components:

$$\Delta G_i = \text{GainError}_i G_i + \text{BiasError}_i \quad (6)$$

The total gain and bias error contained in the accelerometer measurements can then be solved for by substituting these components for ΔGi and using the assumption that $G_{total}$ is about equal to 1 (the idealized value of $G_{total}$) for all survey sets being processed, results in the following calculated error:

$$\Delta G_{total} = \Sigma^{i=x,y,z} G_i^2 \text{GainError}_i + G_i \text{BiasError}_i \quad (7)$$

The Gain and Bias error terms for each axis can be determined using multiple linear regression, where $\Delta G_{total}$ is the dependent variable, and $G_x$, $G_x^2$, $G_y$, $G_y^2$, $G_z$ and $G_z^2$ are the independent variables.

The same method can be applied to the magnetic measurements when the magnetic sensors are suitably misaligned to the borehole axis. The accelerometer measurements can then be adjusted for error by subtracting the calculated errors from the measurements, resulting in greater measurement accuracy.

Error correction calculations such as those described herein may be computed in real-time (for example, by a processor associated with the inclination sensor, either downhole or at a surface facility). For example, a given accelerometer measurement may be compared with a set of past or previously recorded accelerometer measurements. The set of past accelerometer measurements may contain past accelerometer data from a given period of time (for example, from the past hour, the past twenty-four hours, or the past month), or from a predetermined number of the most recent measurements (for example, the last thousand measurements, the last ten thousand measurements, or the last hundred thousand). As such, in one or more embodiments, measurements output by the inclination sensor may have already been error corrected, where no further error correction is necessary.

In one or more embodiments, this error correction can be accomplished during the course of drilling a wellbore (for example, while the drill string is rotating). In one or more embodiments, error correction may be computed on multiple accelerometer measurements at increments of time, such as every minute or every hour, at drilling increments, such as after every hundred meters are drilled, or both. After multiple accelerometer measurements have been taken with the drill string rotated into various orientations while drilling the well, the accelerometer measurements may be examined for variance caused by measurement error. Such measurement error may then be corrected during the drilling operation (for example, while the inclination sensor is within the borehole). In one or more embodiments, the accelerometer measurements may be examined and corrected after drilling a section of the borehole, for example as a post-run quality check.

Other error correcting methods may also be used to correct the acceleration measurements. For example, the gain and bias may be adjusted using the Total Field Calibration method to normalize $G_{total}$ values of the accelerometer measurements. The Total Field Calibration Technique may be used to converge on a set of bias and scale-factor corrections that minimize the residual error in the calculated total field. In one or more embodiments, one or more algorithms known to those of ordinary skill in the art may be used to correct bias, misalignment, and cross-axial magnetometers. In one or more embodiments, any one or more methods known to one of ordinary skill in the art may be applied to further correct accelerometer and magnetometer measurements.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces.

What is claimed is:

1. A measurement system, comprising:

a conveyance for a downhole tool; and an inclination sensor mounted on the conveyance, the inclination sensor comprising:

an inclination sensor body;

a set of downhole tool measurements, wherein the set of downhole tool measurements comprises a set of downhole tool sensors comprising a first downhole tool sensor, a second downhole tool sensor, and a third downhole tool sensor, wherein the first downhole tool sensor, the second downhole tool sensor, and the third downhole tool sensor are disposed out of alignment with the conveyance, wherein each of the first downhole tool sensor, the second downhole tool sensor, and the third downhole tool sensor comprise a measurement axes, wherein the first downhole tool sensor, the second downhole tool sensor, and the third downhole tool sensor are all disposed at different locations along the longitudinal axis of the drill string or wellbore, wherein the measurement axes of each of the first downhole tool sensor, the second downhole tool sensor, and the third downhole tool sensor is out of alignment with a longitudinal axis of the conveyance, wherein the set of downhole tool sensors further comprises a fourth downhole tool sensor, and wherein the fourth downhole tool sensor comprises a measurement axis parallel to the longitudinal axis of the conveyance; and an electronics package, wherein the electronics package receives one or more measurements from at least one downhole tool sensor of the set of downhole tool sensors and compares one or more measurements from the first accelerometer, the second accelerometer, and the third accelerometer to the fourth accelerometer to provide a quality assured measurement.

2. The system of claim 1, wherein the electronics package comprises a data acquisition unit that receives the one or more measurements.

3. The system of claim 2, wherein the electronics package comprises a data processing unit, and wherein the data processing unit determines at least one of an inclination or orientation of the inclination sensor based, at least in part, on the one or more measurements.

4. The system of claim 3, wherein the electronics package communicates the at least one of the inclination or the orientation to an information handling system at a surface.

5. The system of claim 3, wherein the electronics package comprises a telemetry device for communicating at least one of the one or more measurements, the inclination and the orientation to a surface.

6. The system of claim 1, wherein the set of downhole tool sensors are disposed at different points along the longitudinal axis of the conveyance.

7. The system of claim 1, wherein the first downhole tool sensor, the second downhole tool sensor, the third downhole tool sensor, and the fourth downhole tool sensor are each accelerometers, magnetometers, or gyroscopes.

8. A method for determining an inclination of a borehole within a formation, comprising:

obtaining, by a set of accelerometers of an inclination sensor disposed on a conveyance for a downhole tool in the borehole, one or more accelerometer measurements, wherein the set of accelerometers comprises a first accelerometer, a second accelerometer, and a third accelerometer, wherein each of the first accelerometer, the second accelerometer, and the third accelerometer comprises a measurement axes, wherein the measurement axes of the first accelerometer, the second accelerometer, and the third accelerometer are all disposed at different locations along the longitudinal axis of the drill string or wellbore, wherein the measurement axes of each of the first accelerometer, the second accelerometer, and the third accelerometer is out of alignment with a longitudinal axis of the conveyance, wherein the set of accelerometers further comprises a fourth accelerometer, and wherein the fourth accelerometer comprises a measurement axis parallel to the longitudinal axis of the conveyance;

comparing one or more measurements from the first accelerometer, the second accelerometer, and the third accelerometer to the fourth accelerometer to provide a quality assured measurement;

correcting for measurement error at least one of the one or more accelerometer measurements;

determining at least one of an orientation or an inclination of the inclination sensor based, at least in part, on the corrected at least one of the one or more accelerometer measurements; and adjusting one or more drilling parameters based, at least in part, on the at least one of orientation or inclination of the inclination sensor.

9. The method of claim 8, further comprising:

correcting at least one of a magnetometer measurement and a gyroscopic measurement; and determining the at least one of orientation or inclination of the inclination sensor based, at least in part, on the corrected at least one of the magnetometer measurement and the gyroscopic measurement.

10. The method of claim 8, wherein correcting for measurement error comprises correcting at least one of a gain error and a bias error of the at least one of the one or more accelerometer measurements.

11. The method of claim 8, further comprising comparing measurements of the fourth accelerometer to previous measurements of the fourth accelerometer to provide a quality assured measurement.

12. A non-transitory storage computer-readable medium storing one or more instructions that, when executed by a processor, cause the processor to:

obtain, by a set of accelerometers of an inclination sensor disposed on a conveyance for a downhole tool in a borehole, one or more accelerometer measurements, wherein the set of accelerometers comprises a first accelerometer, a second accelerometer, and a third accelerometer, wherein each of the first accelerometer, the second accelerometer, and the third accelerometer comprises a measurement axes, wherein the measurement axes of each of the first accelerometer, the second accelerometer, and the third accelerometer is out of alignment with a longitudinal axis of the conveyance, and wherein the measurement axes of the first accelerometer, the second accelerometer, and the third accelerometer are all disposed at different locations along the longitudinal axis of the drill string or wellbore;

compare one or more measurements from the first accelerometer, the second accelerometer, and the third accelerometer to the fourth accelerometer to provide a quality assured measurement;

correct for measurement error at least one of the one or more accelerometer measurements;

determine at least one of an orientation or an inclination of the inclination sensor based, at least in part, on the corrected at least one of the one or more accelerometer measurements; and adjust one or more drilling parameters based, at least in part, on the at least one of orientation or inclination of the inclination sensor.

13. The non-transitory storage computer readable medium of claim 12, wherein obtaining the one or more accelerometer measurements comprises obtaining at least one accelerometer measurement from a fourth accelerometer of the set of accelerometers, wherein the set of accelerometers further comprises a fourth accelerometer, wherein the fourth accelerometer comprises a measurement axis parallel to the longitudinal axis of the conveyance.

14. The non-transitory storage computer readable medium of claim 12, wherein the one or more instructions, that when executed by the processor, further cause the processor to store a record of one or more previous accelerometer measurements from the set of accelerometers in a storage device coupled to the electronics package.

15. The non-transitory storage computer readable medium of claim 14, wherein correcting for measurement error at least one of the one or more accelerometer measurements comprises reading the record of the one or more previous accelerometer measurements from the storage device.

16. The non-transitory storage computer readable medium of claim 12, wherein correcting for measurement error at least one of the one or more accelerometer measurements comprises correcting the one or more accelerometer measurements for at least one of bias error or gain error.

17. The non-transitory storage computer readable medium of claim 12, wherein the one or more instructions, that when executed by the processor, further cause the processor to obtain, by a set of magnetometers of an inclination sensor disposed on the conveyance in a wellbore, one or more magnetometer measurements, wherein the set of magnetometers comprises a first magnetometer, a second magnetometer, and a third magnetometer, wherein each of the first magnetometer, the second magnetometer, and the third magnetometer comprises a measurement axes, and wherein the measurement axes of each of the first magnetometer, the second magnetometer, and the third magnetometer is out of alignment with a longitudinal axis of the conveyance;

correct for measurement error at least one of the one or more magnetometer measurements; and determine an azimuth from the one or more magnetometer measurements to determine the azimuth of at least a portion of the borehole.

18. The non-transitory storage computer readable medium of claim 17, wherein the one or more instructions, that when executed by the processor, further cause the processor to store a record of one or more previous magnetometer measurements from the set of magnetometers in a storage device coupled to an electronics package, wherein correcting for measurement error at least one of the one or more magnetometer measurements comprises correcting the one or more magnetometer measurements for at least one of bias error or gain error.

19. The non-transitory storage computer readable medium of claim 12, wherein the one or more instructions, that when executed by the processor, further cause the processor to obtain, by a set of gyroscopes of an inclination sensor disposed on the conveyance in a wellbore, one or more gyroscopic measurements, wherein the set of gyroscopes comprises a first gyroscope, a second gyroscope, and a third gyroscope, wherein each of the first gyroscope, the second gyroscope, and the third gyroscope comprises a measurement axes, and wherein the measurement axes of each of the first gyroscope, the second gyroscope, and the third gyroscope is out of alignment with a longitudinal axis of the conveyance;

correct for measurement error at least one of the one or more gyroscopic measurements; and determine an azimuth from the one or more gyroscopic measurements to determine the azimuth of at least a portion of the borehole.

* * * * *